United States Patent [19]

Bradt et al.

[11] Patent Number: 4,793,774

[45] Date of Patent: Dec. 27, 1988

[54] VARIABLE DISPLACEMENT HIGH PRESSURE PUMP

[75] Inventors: Howard J. Bradt, Whitesboro; Steven B. Croke, Utica, both of N.Y.

[73] Assignee: Allied-Signal Inc., Morris Township, Morris County, N.J.

[21] Appl. No.: 101,892

[22] Filed: Sep. 28, 1987

[51] Int. Cl.[4] ..... F04B 23/10; F04B 23/14; F04B 1/28

[52] U.S. Cl. ..... 417/203; 417/222; 92/12.2

[58] Field of Search ..... 417/203, 205, 222, 269; 92/12.2, 71

[56] References Cited

U.S. PATENT DOCUMENTS

| | | | |
|---|---|---|---|
| 2,620,733 | 12/1952 | Overbeke | 417/203 |
| 3,058,297 | 10/1962 | Tolley | 417/222 |
| 3,183,844 | 5/1965 | Pitt et al. | 92/12.2 |
| 3,498,227 | 3/1970 | Kita | 417/269 |
| 3,873,240 | 3/1975 | Leduc et al. | 417/222 |
| 4,072,444 | 2/1978 | Kaiser | 417/269 |
| 4,149,830 | 4/1979 | Woodruff | 417/222 |
| 4,174,191 | 11/1979 | Roberts | 417/222 |
| 4,281,971 | 8/1981 | Kouns | 417/203 |
| 4,710,107 | 12/1987 | Kanies | 417/269 |

FOREIGN PATENT DOCUMENTS

| | | | |
|---|---|---|---|
| 968435 | 2/1958 | Fed. Rep. of Germany | 417/222 |
| 169880 | 10/1921 | United Kingdom | 417/222 |

*Primary Examiner*—William L. Freeh

*Attorney, Agent, or Firm*—Howard G. Massung

[57] ABSTRACT

A variable displacement piston pump (10) including a plurality of axially aligned pumping cylinders (24) with a drive shaft (40) extending there between having a tiltable swash plate (30) disposed in a relatively dry cavity at one end of the drive shaft (40) for operating the pumping cylinders, and a reaction thrust plate (38) on the other end of the drive shaft (40), for providing reaction force in the drive shaft (40) opposite that provided by the swash plate (30). An inlet shaft seal (72) prevents fluid, which enters the pump at the inlet port (12), from filling the mounting housing (17) and submerging the mount shaft (44) portion of rotating assembly (16) and its supported swash plate (30). Two needle roller bearings (67) support the swash plate (30) and transmit torque from the drive coupling (19) to the swash plate (30). A high pressure fluid restrictor (70) meters hydraulic control fluid to the two needle bearings (67).

22 Claims, 3 Drawing Sheets

VARIABLE DISPLACEMENT HIGH PRESSURE PUMP

BACKGROUND OF THE INVENTION

1. Field of the Invention

This invention relates to variable displacement piston pumps and particularly to pumps of the type described which are compensated to maintain constant pressure with variable flow. More particularly, this invention relates to a pump wherein the shaft assembly can rotate without dissipating energy by stirring hydraulic fluid.

2. Description of the Prior Art

A type of variable displacement piston pump known in the prior art, includes a shaft having a driven end and an opposite end arranged for supporting a swash plate. The swash plate is caused to pivot or slide about a fixed axis displaced from and generally perpendicular to the center line of the driven shaft. The swash plate is disposed in a cavity filled with the hydraulic fluid to be pumped. A plurality of cylinders having pistons disposed therein are arranged with associated check valves in a fixed pump block. During the delivery stroke of the pistons, pressure in the cylinders becomes high enough to open the check valves and deliver fluid to a common discharge manifold. When the manifold pressure approaches a predetermined set value, a force is created which is transmitted to the swash plate and slidingly pivots the swash plate about the fixed axis, away from a maximum flow position. The pistons are arranged with respect to the swash plate so that when the swash plate pivots away from the maximum flow position, the stroke of the pistons are decreased to reduce fluid flow and pressure. Equilibrium is thus established and reduced fluid flow at a predetermined substantially constant pressure is maintained. A Prior art example of such a pump is described in U.S. Pat. No. 4,149,830 having Frank Woodruff as the named inventor.

In the pump disclosed in U.S. Pat. No. 4,149,830, a plurality of piston assemblies are permitted to reciprocate in a cylinder block which is fixed to the pump casing. The swash plate, in addition to pivoting to achieve equilibrium is caused to rotate. The rotation of the swash plate forces the pistons to reciprocate, thus achieving the desired pump action. The drive shaft and the attached swash plate form a rotating assembly.

In aircraft hydraulic systems, it is important to maintain high efficiencies in order to minimize weight and power requirements. In prior art pumps, the rotating assembly is typically submerged in hydraulic fluid, and therefore must rotate and stir that fluid as the pump operates. This prior art construction reduces pump efficiency and therefore necessitates more input power.

In some prior pumps an arcuate cutout in the pump's shaft assembly supports the swash plate. This forms a sliding interface associated with varying the displacement of the pump. The frictional resistance to the onset of this sliding action causes a delay in the desired pivoting motion of the swash plate. Unwanted discharge pressure fluctuation may thus be caused by the swash plate's resistance to pivoting. It is desirable in aircraft applications to provide a high pressure variable output pump which is light in weight and has a smooth output.

SUMMARY OF THE INVENTION

In the disclosed variable displacement high pressure piston pump the swash plate which tilts in response to a control fluid pressure is not disposed in hydraulic fluid.

The control fluid which positions the swash plate is supplied through an intermediate transfer tube within a hollow drive shaft to decrease the control fluid volume and speed response. This control fluid is supplied, by the pressure compensating valve, at an intermediate pressure such as 27,580 KPa (4000 psi).

The drive shaft assembly includes two needle or roller bearings which both support and drive the tiltable swash plate. These roller bearings alleviate the friction associated with conventional sliding trunnions. Long bearing life is facilitated by hydraulic fluid which is supplied to the needle or roller bearings through the pump shaft. A high pressure restrictor is incorporated in the pump shaft to meter a small amount of control fluid to these bearings at low, ambient pressure.

A shaft seal disposed around the drive shaft within the center hole through the cylinder block, keeps the hydraulic fluid at the pump inlet from filling the cavity in which the tiltable swash plate is housed. Fluid which leaks into the swash plate cavity is removed thru a drain port. The swash plate and its associated mounting shaft can thus rotate without being submerged in hydraulic fluid. This construction reduces energy loss caused by the stirring of fluid by the rotating swash plate assembly.

BRIEF DESCRIPTION OF THE DRAWINGS

For a better understanding of the invention, reference may be had to the preferred embodiment exemplary thereof shown in the accompanying drawings in which.

DETAILED DESCRIPTION OF THE INVENTION

Figure 1:
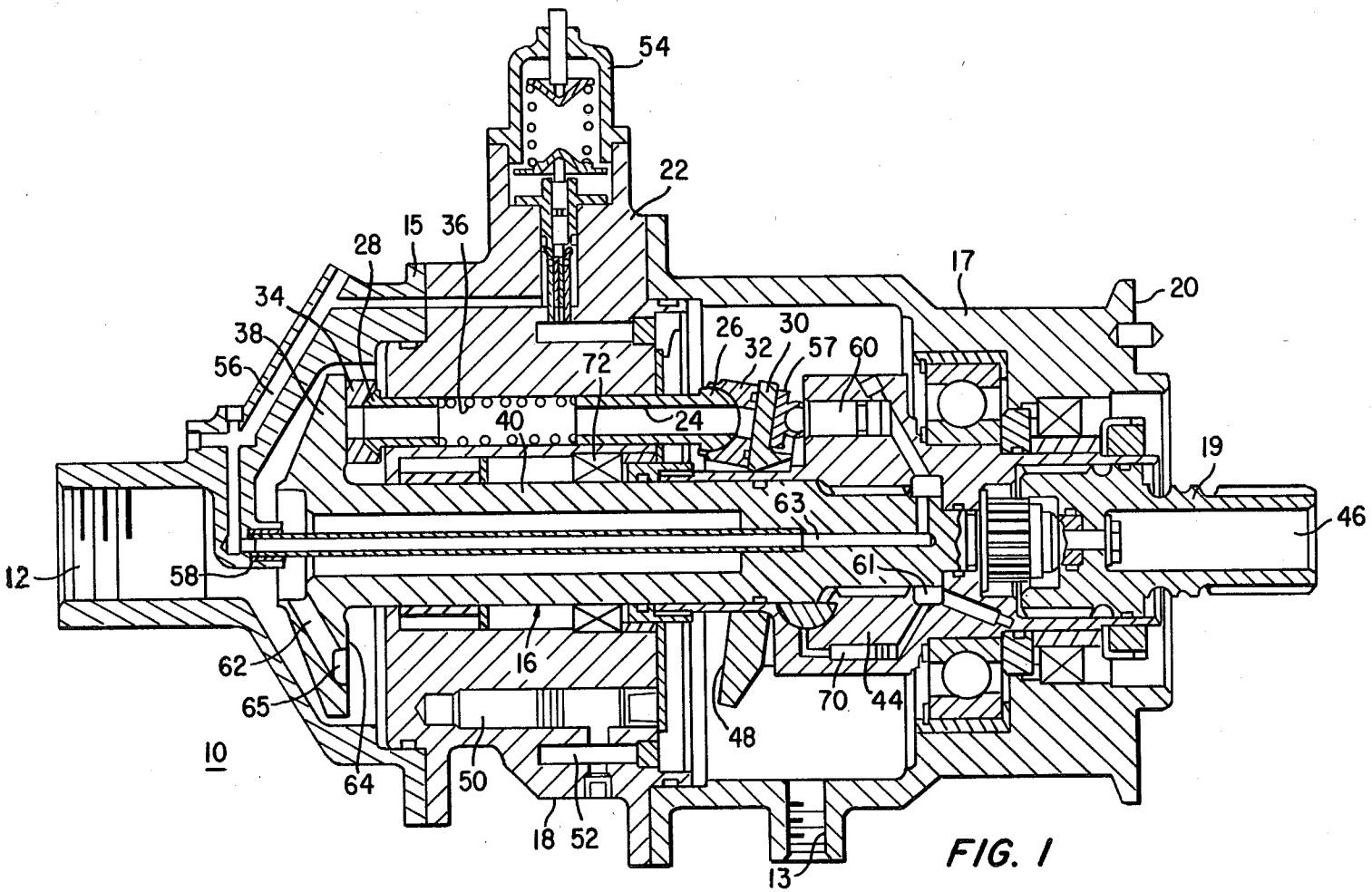
FIG. 1 is a section view taken in FIG. 2 along the lines I—I of a pump constructed according to the present invention.
Figure 3:
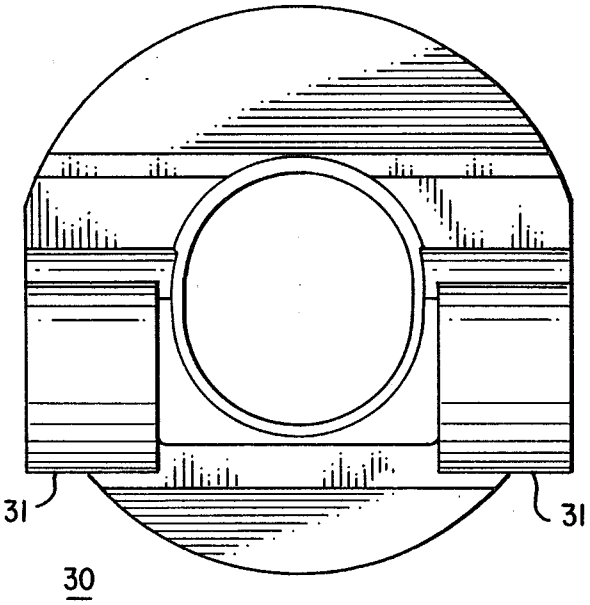
FIG. 3 is a top view of the swash plate.
Figure 2:
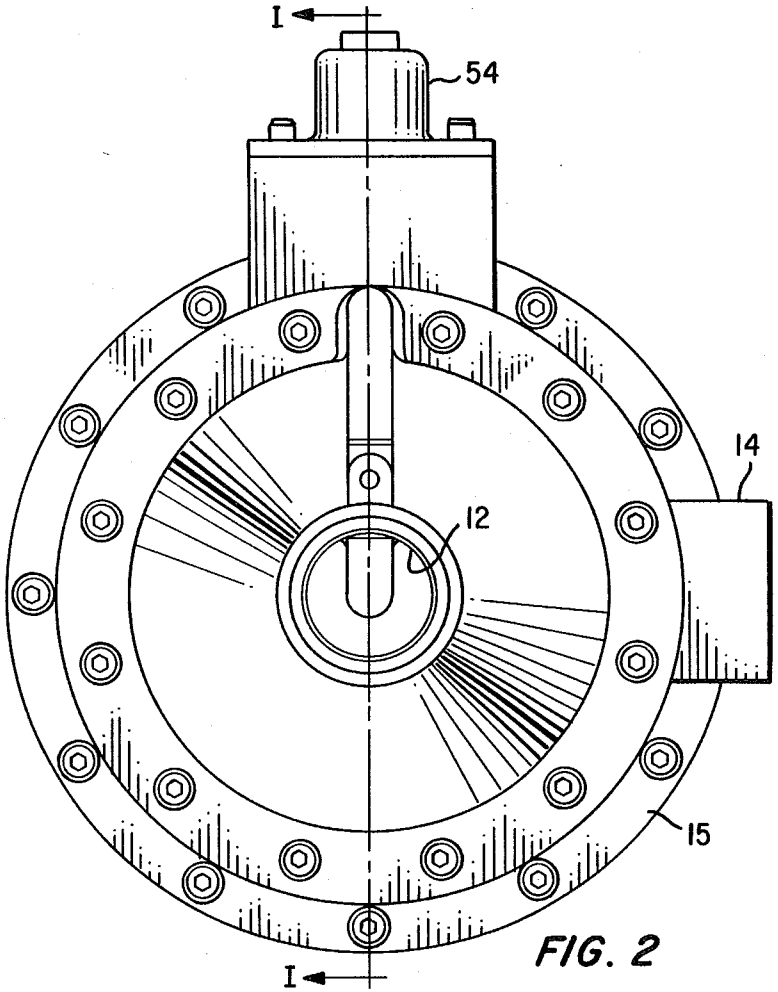
FIG. 2 is an inlet end view of a piston pump utilizing the present invention.
Figure 4:
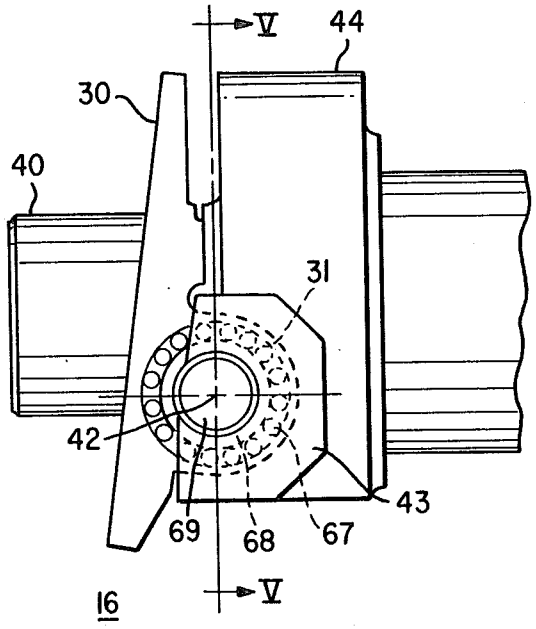
FIG. 4 is a detailed view of a portion of the drive assembly including the swash plate and supporting bearings; and, FIG. 5 is a section view taken in FIG. 4 along the line V—V with the swash plate and bearings deleted for clarity.
Figure 5:
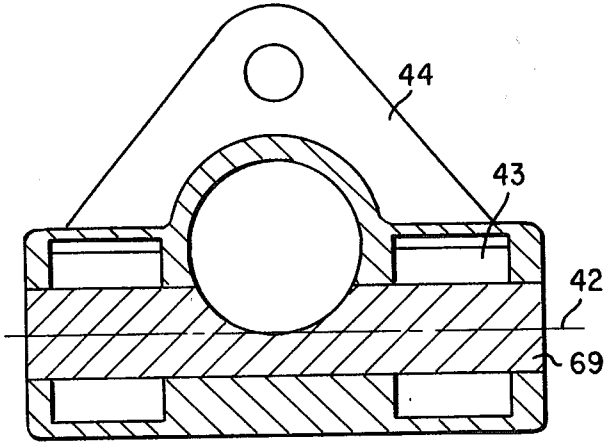

Referring now to the drawings, there is shown a variable displacement high pressure piston pump 10 constructed according to the teaching of the present invention. Pump 10 is capable of working at high pressures, 55,160 KPa (8000 psi) and above, and is relatively lightweight and suitable for aircraft hydraulic systems. Hydraulic fluid is fed at low pressure to pump 10 through an inlet port 12 and is discharged at the desired pressure from an outlet port 14. Pump 10 includes a rotating assembly 16 which rotates within a housing 18. Housing 18 includes a mounting flange 20 by which pump 10 is mounted to a suitable power source such as a gear casing of a gas turbine engine (not shown). The rotating assembly 16 includes a splined input shaft having spline teeth or other suitable means for engaging a power take off output of the power source.

A fixed steel cylinder block 22 having a plurality of cylinder bores 24 formed therein is disposed between aluminum end members 15 and 17 to form part of a housing 18. While cylinder block 22 includes a plurality of cylinder bores 24 only one is shown in the section view of FIG. 1 and operation of only one will be described. Cylinder block 22 is fixed between members 15, 17 and its outer surface is exposed as part of the housing or shell 18. Each cylinder 24 in block 22 houses an active pumping piston 26 and a dummy piston 28. Active pistons 26 receive their motion from rotation of an inclined swash plate 30. The outer end of active piston 26 engages a shoe 32 and the outer end of dummy piston 28 engages a shoe 34. A spring 36 is disposed in cylinder 24 to bias apart pistons 26 and 28.

Shoe 32 on active piston 26 engages swash plate 30 while shoe 34 at the free end of dummy piston 28 engages a thrust plate centrifugal impeller 38. Rotatable drive assembly 16 includes a center shaft 40 extending to form integral thrust plate 38. The axial forces, generated during pumping, on swash plate 30 also react on shaft 40 and the axial forces are contained within the rotating drive assembly 16 and not transmitted to housing 18.

As can be seen, active piston 26 moves with respect to cylinder 24 as swash plate 30 rotates to effect pumping action. The dummy piston 28 remains substantially in the same position with respect to cylinder 24 while pumping; although, it is free to float in order to adjust for discrepencies in the relative distances between parts of the rotating assembly 16 and in order to transfer axial forces from the pumping action of the active piston 26 outside of cylinder 24 to the thrust plate 38.

Swash plate 30 has a center opening therethrough and is mounted around center shaft 40. Swash plate 30 is pivotally mounted to the rotating shaft assembly 16. Circular projections 31 on swash plate 30 house needle bearings 67. The inner rings 68 of bearings 67 are supported by trunnion pin 69 which fits tightly into mount shaft 44. The operation of swash plate 30 is conventional and is described in detail in U.S. Pat. No. 4,149,830. Briefly, swash plate 30 pivots relative to mount shaft 44 around axis 42. The drive shaft assembly 16 employs needle bearings 67 which both support and drive the swash plate 30. Easy movement of swash plate 30 is made possible by utilizing a high pressure fluid restrictor 70 to meter hydraulic fluid from control passage 63 into each needle bearing 67. Swash plate 30 is pinned to mount shaft 44 by trunnion pin 69 through needle bearing 67. Swash plate 30 pivots about center 42 on the needle bearings 67 which rotate with trunnion pin 69. Tuunnion pin 69 is rigidly pressed into mount shaft 44 Swash plate 30 pivots on the needle bearings 67 in response to discharge pressure. Pressurized fluid for controlling the inclination of swash plate 30 is provided by compensating valve 54 through passage 56 and a rotating tube seal 58 through passage 63 to a chamber 61 behind piston 60. This control fluid is provided at an intermediate pressure such as 27,580 KPa (4000 psi). Piston 60 has a swivellable shoe 57 which contacts and tilts swash plate 30 around axis 42.

The aforementioned rotating tube seal 58 replaces the balanced piston seal used in some prior pumps. A shaft seal 72 housed in the center hole through piston block 22 and encircling shaft 40 keeps fluid which enters at inlet port 12 from filling the cavity in housing 17 where rotating mount shaft 44 and swash plate 30 are located. Any fluid which leaks into the cavity where swash plate 30 is housed, is drained from pump 10 thru an external port 13 in pump housing 18. The fluid drained from pump 10 is returned to the system at or above inlet pressure by means of a scavenge pump (not shown).

Shoe 32 on active piston 26 engages swash plate 30 while shoe 34 at the free end of dummy piston 28 engages the thrust plate centrifugal impeller 38. Rotatable drive assembly 16 including the center shaft 40 extends to form integral thrust plate 38. The axial forces, generated during pumping, on swash plate 30 also react on shaft 40 and the axial forces are contained within the rotating drive assembly 16 and not transmitting to housing 18.

As can be seen, active piston 26 moves with respect to cylinder 24 as swash plate 30 rotates to effect pumping action. The dummy piston 28 remains substantially in the same position with respect to cylinder 24 while pumping; although, it is free to float in order to adjust for discrepancies in the relative distances between parts of the rotating assembly 16 and in order to transfer axial forces from the pumping action of the active piston 26 outside of cylinder 24 to the thrust plate 38.

Swash plate 30 pivots on needle bearings 67 in response to outlet pre sure. Swash plate 30 may be positioned at varying angles to the center axis of pump 10. Swash plate 30 is rotationally fixed to center shaft 40 and therefore, whenever its working face 48 is displaced from the perpendicular with respect to axis 46, active pistons 26 are reciprocated as drive assembly 16 rotates. In order to reduce pumping action, swash plate 30 is pivoted to bring the working surface 48 towards perpendicular alignment with axis 46. To increase pumping action, swash plate 30 is tilted at a greater angle with respect to perpendicular alignment with axis 46. Tilting of swash plate 30 is accomplished through pressurized fluid, at the outlet pressure, within passage 63.

Shoes 32 are hydraulically balanced at both the piston 26 and swash plate 30 interface. Likewise, shoes 34 are hydraulically balanced at both piston 28 and thrust impeller plate 38. The shoes 32, 34 are similar to shoes described in U.S. Pat. No. 4,149,830. Pressure balancing of shoes 34, 32 is accomplished by the through hole,and the vented annulus cut in the end of the shoe away from its associated piston 26, 28. The through hole pressure plus pressure distribution across the ends balance any forces developed by the pistons. The vented annulus helps to provide a constant fluid film and prevent over pressurization.

Each cylinder pump has associated therewith a check valve assembly 50, one of which is shown in FIG. 1. Minimizing discharge pulsations in a high pressure pump unit is an important criteria towards accurate system performance. An effective way of achieving a smooth pulse trace is through the use of individual check valves 50 with each pumping cylinder 24. During discharge, fluid from each check valve piston assembly will be expelled just after system pressure plus valve spring force return is met. There is no possibility of exposing the system t a lesser discharge than desired; therefore, the possibility of increased pulsation is reduced. The discharge from pumping cylinders 24 during operation is through the associated check valve 50 into a common manifold 52.

To maintain a constant discharge pressure, a compensating valve 54, which communicates with manifold 52 is utilized. Compensating valve 54 is described in detail in U.S. Pat. No. 4,182,365. Compensating valve 54 modulates discharge pressure. Pressurized fluid for controlling the inclination of swash plate 30 is provided by compensating valve 54 through passage 56 and seal 58 through passage 63 to a chamber 61 behind piston 60. When fluid flow from pump 10 is greater than conditions require, discharge pressure increases. The resulting intermediate pressure in passage 56, 63 is increased allowing tilt piston 60 pressure to increase. This pressure increase will move piston 60 to the left in FIG. 1, lessening the swash plate angle and thereby decreasing flow. The converse of the above description applies when conditions require an increase in flow.

Piston 60 includes a swivellable shoe 57 which engage and tilt swash plate 30 around axis 42. When piston 60 is forced to the left as shown in FIG. 1, swash plate 30 is moved towards vertical alignment and thereby decreases the stroke of working piston 26. The Inlet to pump housing 18 is through port 12. Passage 62 is formed in the thrust plate 38 which extends from the center shaft 40. Thrust plate 38 during operation acts as a centrifugal pump, boosting the pressure of the hydraulic fluids supplied into port 12. Thrust plate 38 includes a working surface 64 on which shoes 34 ride as plate 38 rotates. Passage 62 connects to an opening 65 in the working face 64 of thrust plate 38. As thrust plate 38 rotates, when the opening 65 in the working surface 64 aligns with the opening in shoe 34, fluid passes through dummy piston 28 into cylinder 24. Force balancing of the working piston 26 thrust load is accomplished by dummy piston 28, which is placed opposite the working piston 26. Dummy piston 28 rides through shoe 34, on thrust plate 38 and transmits negative forces required to balance the positive forces of working piston 26. The working surface 34 of thrust plate 38 is used as the dummy piston 28 bearing surface. The dummy pistons 28 are used to create an equal force opposite to the force developed by the working pistons 26. This approach saves weight and decreases the envelope size. The larger bearings as required in prior art high pressure similar type piston pumps are not required.

The disclosed high pressure variable displacement piston pump will boost an inlet pressure of 103 KPa (15 psi) to 55,160 KPa (8000 psi) or greater and hold it there under a variety of flow and speed conditions. By providing a centrifugal pump impeller plate 38 integral with the drive shaft 40, the inlet fluid pressure can be raised as a function of rotational speed by an amount such as 138 KPa (20 psi). This avoids cavitation in the pump. The rotating swash plate 30 provides the reciprocating action for the working piston 26 assembly. Once system pressure has been developed by a piston, its associated check valve 50 will open thereby releasing fluid to the pump manifold 52 and discharge port 16. In a pump having several working pistons, the pulse magnitude is a small percent of the discharge pressure. Return springs 36, which assist in the suction stroke, in the piston pump assembly are required only for cold start up. Once system pressure has been established, the spring force when pumping becomes insignificant. Control valve 54 through piston 60 and tilting of swash plate 30 controls the output pressure. Control valve 54 operates until an equilibrium has been achieved and pressure will hold constant. Following changes in the load, control valve 54 causes corresponding corrections of the swash plate 30 angle. The pressure in line 56 to piston 60 is that pressure required to balance the moment which is transmitted to the swash plate by the pump piston. This is an intermediate pressure such as 27,580 (4000 psi).

What is claimed:

1. A variable displacement multiple piston pump having an inlet and an outlet disposed on a housing which includes a cylinder block with a plurality of cylinders each having a pumping piston which is caused to reciprocate by a swash plate disposed in a cavity and tiltable in response to outlet pressure to vary the stroke of the pumping piston to maintain the output pressure relatively constant, the improvement comprises:

a longitudinally extending drive shaft extending through an opening in the swash plate and the cylinder block;

swash plate connecting means for connecting the swash plate to one end of the drive shaft and transferring axially generated pumping forces to the drive shaft;

a thrust plate attached to the other end of said drive shaft;

transfer means disposed between said thrust plate and said cylinder block for transferring forces to the thrust plate and the attached drive shaft which are opposite the forces transferred to the drive shaft from the swash plate; and, mechanical seal means for preventing inlet fluid from filling the cavity in which the tiltable swash plate is disposed.

2. A pump as claimed in claim 1 wherein said swash plate connecting means comprises:

one or more bearings for supporting and permitting rotating displacement of said swash plate from said drive shaft.

3. A pump as claimed in claim 1 comprising:

cylinder filling means for admitting fluid to be pumped only into the end of each cylinder opposite the swash plate during an intake stroke.

4. A pump, having a housing with an inlet and an outlet, comprising:

a plurality of cylinders disposed in said housing, each including a reciprocable piston means for pumping fluid in its associated cylinder;

an elongated drive shaft disposed in the housing;

swash plate means disposed in a cavity and connected to one end of said drive shaft for engaging and moving into each cylinder its associated, reciprocable piston means as said drive shaft rotates and for transferring positive pumping generated forces to said drive shaft;

a thrust plate disposed at the opposite end of said drive shaft;

means for transferring through the thrust plate to the drive shaft forces opposite those transferred to the drive shaft by the swash plate means; and mechanical seal means disposed around said elongated shaft for preventing fluid to be pumped from filling the cavity in which the swash plate rotates.

5. A pump as claimed in claim 4 comprising:

a common manifold for receiving pressurized fluid pumped by each reciprocable piston means;

a check valve associated with each cylinder disposed between the cylinder and the common manifold; and means for filling each cylinder during intake from the thrust plate end only.

6. A pump as claimed in claim 5 comprising:

bearing means for supporting said swash plate from said drive shaft.

7. A pump as claimed in claim 6 wherein:

said swash plate means comprises a tiltable swash plate; and, means for changing the tilt of said tiltable swash plate relative to the longitudinal axis of the drive shaft comprising a tube which communicates with fluid at the pump outlet extending through a larger opening in the drive shaft.

8. A variable displacement piston type pump comprising:

a housing having an inlet and an outlet;

a cylinder block disposed in said housing having a plurality of cylinders formed therein;

a plurality of active pistons, one disposed in each of the cylinders, biased to extend from the cylinder;

a swash plate disposed in a cavity and engaging a portion of each piston extending from its associated cylinder and being tiltable and rotatable to engage and move the piston varying distances as a function of swash plate tilt;

drive means including roller bearings for supporting and driving said swash plate from a shaft extending through said swash plate and said cylinder block;

a thrust plate disposed on the drive shaft opposite said swash plate;

means partially disposed in the cylinders of said cylinder block opposite the active pistons for transferring to said thrust plate an axial force opposite to the force transferred by said swash plate to said drive shaft during pumpign operation; and seal means for providing a seal to prevent fluid at the pump inlet from filling the cavity surrounding said swash plate.

9. A pump as claimed in claim 8 wherein:

said thrust plate comprises a centrifugal pump impeller which communicates with the inlet to boost pressure of incoming fluids.

10. A variable dispalcement piston type pump, in which a swash plate rotates relative to a plurality of pistons and is adjusted thru a tilt angle in order to adjust the travel of the pistons and consequently, the output of the pump, characterized by:

a housing containing fluid;

a shaft disposed in the housing, one end of the shaft arranged for being rotatably driven to operate the pump;

the swash plate tiltably supported, within a cavity formed in said housing, by said shaft for displacement about a pivot axis displaced from and transverse to the shaft axis;

at least one cylinder assembly having a cylinder bore extending there through and having at least one piston reciprocally mounted in the cylinder bore, the piston arranged with the swash plate so that the piston stroke varies with the swash plate tilt angle;

means arranged within the housing,and the cylinder assembly so that fluid flows from the housing to the cylinder assembly during a pump intake stroke and is blocked from flowing during a pump delivery stroke;

a pump discharge manifold;

check valve means arranged between the manifold and the cylinder and actuated by a fluid pressure difference between the cylinder and the manifold during a delivery stroke of the piston for permitting passage of a fluid from the cylinder to the manifold, whereupon a pressure is created in the manifold;

means for controlling manifold pressure by displacing the swash plate and thereby varying the stroke of the piston;

means axially fixed to said shaft for providing a reaction force to the swash plate in response to the pumping action of the swash plate; and seal means for preventing fluid in said housing from filling the cavity within which said swash plate is supported.

11. Apparatus as claimed in claim 10, further characterized by:

a means for providing a reaction force includes a second piston disposed within the cylinder and reacting to fluid force from the first piston and arranged so that fluid pressure within the cylinder causes the first and second pistons to exert reactive forces having at least one set of opposite vector components.

12. Apparatus as described in claim 10, further characterized by:

the cylinders being aligned substantially parallel to the drive shaft.

13. Apparatus as described in claim 12, further characterized by:

a shoe interposed between the first piston and the swash plate and bearing against the swash plate in order to transfer forces between the swash plate and the piston.

14. Apparatus as described in claim 13, further characterized by:

the means for providing a reaction force includes a thrust plate which is fixed to said shaft; and means associated with the second piston to bear against said thrust plate.

15. Apparatus as claimed in claim 14, further characterized by:

said thrust plate comprises a centrifugal pump impeller for increasing the pressure of incoming fluid.

16. Apparatus as described in claim 14, further characterized by:

bearing means disposed between said swash plate and said shaft for low friction supporting of said swash plate from said shaft.

17. A variable displacement multiple piston pump having an inlet chamber with an inlet and an outlet disposed in a housing which includes a cylinder block with a plurality of cylinders each having a pumping piston which is caused to reciprocate by a rotating a swash plate disposed in a pump cavity and tiltable in response to outlet pressure to vary the stroke of the pumping piston to maintain the output pressure at the outlet relatively constant, the improvement comprises:

a drive shaft extending through the pump cavity, the cylinder block and into th inlet chamber;

a thrust plate disposed in the inlet chamber and mounted on said drive shaft; and a mechanical seal which prevents fluid at the inlet chamber from filling the pump cavity in which the tiltable swash plate rotates.

18. A variable displacement pump as claimed in claim 17 further characterized by:

one or more trunnion bearings as the means for supporting the swash plate for tilting and for rotating the swash plate.

19. A variable displacement pump as claimed in claim 18 further characterized by:

a mount shaft which through said one or more trunnion bearings supports the swash plate; and, a high pressure fluid restrictor, located in the mount shaft, which allows small quantities of fluid to lubricate the trunnion bearings.

20. A variable displacement piston type pump for pumping hydraulic fluid comprising:

a housing having an inlet chamber and an outlet;

a cylinder block disposed in said housing having a plurality of cylinders formed therein;

a plurality of active pistons, one disposed in each of the cylinders, biased to extend from the cylinder, a swash plate disposed in a cavity and engaging a portion of each piston extending from its associated cylinder and being tiltable and rotatable to engage and move the piston varying distances as a function of swash plate tilt;

a thrust plate disposed in said inlet chamber opposite said swash plate with said cylinder block disposed therebetween;

a drive shaft having said thrust plate attached to one end and extending through said cylinder block to support said swash plate; and, seal means disposed between the inlet chamber and the cavity in which said swash plate is disposed for preventing hydraulic fluid from filling the cavity.

21. A variable displacement piston type pump as claimed in claim 20 comprising:

a mount shaft for supporting said swash plate; and, a pair of bearings disposed between said mount shaft and said swash plate.

22. A variable displacement piston type pump as claimed in claim 21 comprising:

restrictor means for metering a small quantity of hydraulic fluid to said pair of bearings.

* * * * *